US005632488A

United States Patent [19]

Sturm et al.

[11] Patent Number: 5,632,488

[45] Date of Patent: May 27, 1997

[54] EDUCATIONAL POLITICAL CARD GAME APPARATUS AND METHOD OF PLAY

[76] Inventors: William C. Sturm; Cynthia R. Sturm, both of 2777 Madison Ave., Bethlehem, Pa. 18017

[21] Appl. No.: 508,633

[22] Filed: Jul. 28, 1995

[51] Int. Cl.[6] ..... A63F 1/00; A63F 1/10

[52] U.S. Cl. ..... 273/293; 273/296; 273/302; 273/308; 273/430; 273/148 A; 434/322; 434/327

[58] Field of Search ..... 273/293, 148 A, 273/295, 296, 302, 308, 430; 40/661, 537, 124.1, 124.2; 434/327, 322

[56] References Cited

U.S. PATENT DOCUMENTS

| | | | |
|---|---|---|---|
| 678,791 | 7/1901 | Ford | 273/296 |
| 1,292,184 | 1/1919 | Wells | 273/296 |
| 3,068,010 | 12/1962 | Hagopian | 273/295 |
| 4,657,248 | 4/1987 | Benaim | 434/327 |
| 5,323,553 | 6/1994 | Candido | 40/537 |
| 5,467,997 | 11/1995 | Bashirzadeh | 273/302 |

*Primary Examiner*—Benjamin H. Layno
*Attorney, Agent, or Firm*—Charles A. Wilkinson

[57] ABSTRACT

A card game comprising a plurality of playing cards representing current U.S. political figures. Each playing card has a front surface and a back surface. The front surface displays a picture of a political figure accompanied by his/her name and job title. The back surface contains information about the political figure depicted on the front surface. Each playing card may also include information encoded thereon indicating the political ideology (Liberal, Moderate, Conservative, or the like) of the political figure depicted on the front surface. The encoded information is not immediately decipherable by the casual observer. The playing cards may be integrated into a game system via a looseleaf-type game binder divided into state sections representing the states of the United States. The game binder may include apparatus for revealing the encoded political ideology of each political figure when his/her playing card is placed therein. The game binder may also include apparatus for storing and organizing the playing cards. The object of the game is to build a "political consensus" by being the first player to possess a predetermined number of playing cards representing political figures all of whom share the same political ideology.

15 Claims, 4 Drawing Sheets

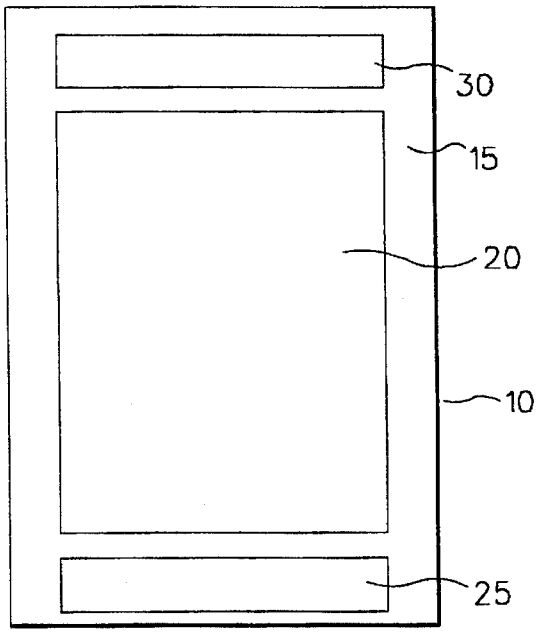
Fig. 1a
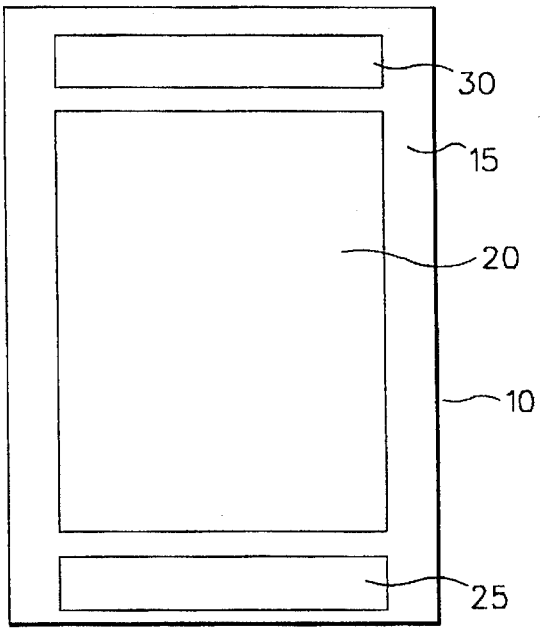
Fig. 1b
Fig. 2
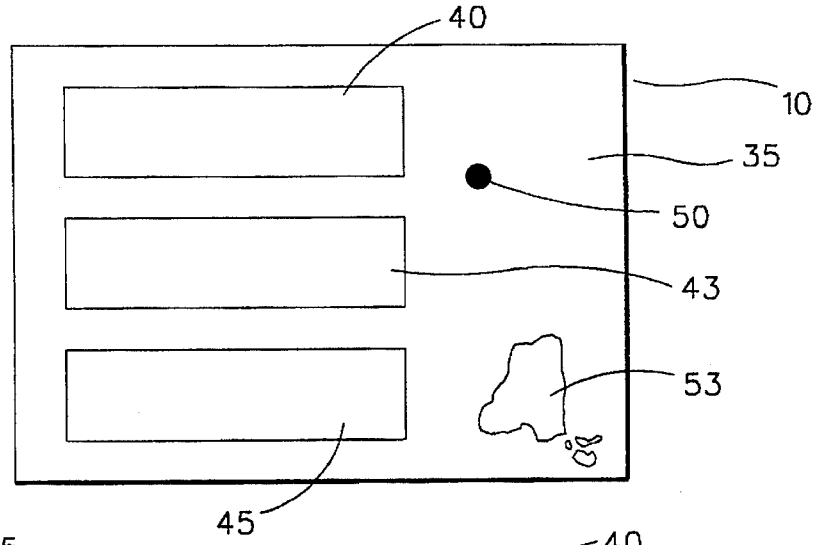
Fig. 3
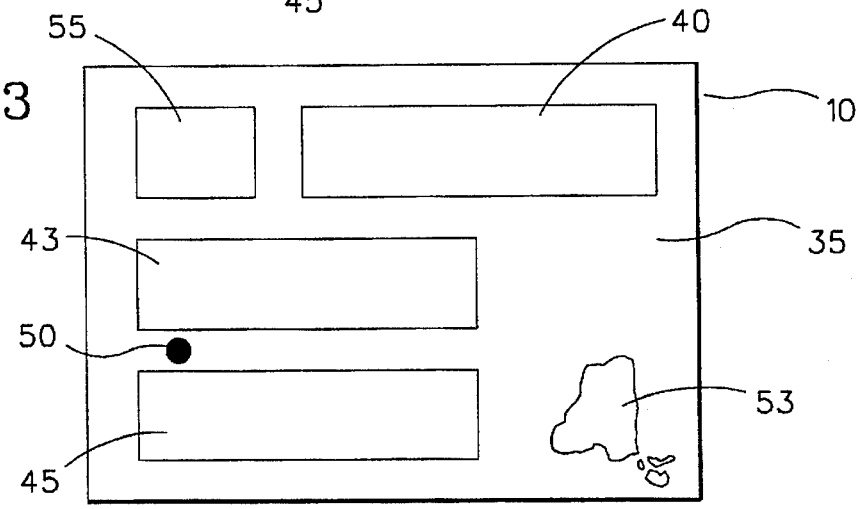

EDUCATIONAL POLITICAL CARD GAME APPARATUS AND METHOD OF PLAY

BACKGROUND OF THE INVENTION

1. Field of the Invention

This invention relates, generally, to playing cards, and, more particularly, to playing cards and card games, and, even more particularly, to cards and card games that are used for educational purposes, and, still more particularly, to cards and card games that are used to educate players about current U.S. political figures.

2. Background Art

Playing cards and card games are a part of human social history. Over the centuries, cards have found their way into palaces and hovels, monasteries and taverns, riverboats and fortune-telling booths. They have been used to instruct young Louis XIV of France in subjects ranging from geography to Greek mythology, and they have been used to teach memory skills (eg. the game "Concentration") and elementary arithmetic (eg. the game "Twenty-Four") to modern-day school-age children. Playing cards have also been used to enrich the cardsharp and impoverish the unwary. Indian legend asserts that playing cards were even used by the wife of a Maharajah to wean him from the habit of pulling his beard.

Numerous theories as to the origin of playing cards abound. Such theories are seldom probable, occasionally romantic, and rarely capable of proof. Some scholars point to the Far East of the 12th century as the birth-place of playing cards. Others argue that playing cards are the product of 14th century European genius. Supporters of the Far East pedigree maintain that both chess and cards are derived from a combination of the Korean divinatory arrow and Chinese paper money. Those espousing European origin rely on, among other things, a manuscript, dated 1377, written in Latin by Johannes, a German monk who lived in a Swiss monastery, from which manuscript it evidently can be gleaned that playing cards originated in the West in or about the year 1370. Whatever their true birthright, what is certain is that playing cards are of old and mixed descent and know many uses other than gaming.

As alluded to above, playing cards have proved useful, generally, as educational tools. Currently, there is a need for effective educational tools to combat the related problems of political ignorance and voter apathy in this country. The present invention is directed to employing playing cards to satisfy this need.

Many who profess to monitor the political culture in the United States see a political system in decline. The steady decline in voting is the most visible evidence that something is wrong. According to the Committee for the Study of the American Electorate, voting in presidential elections has declined 20% since 1960. Almost half of those eligible to vote stay home, despite extravagant campaigns and extensive media coverage. In the representative branch, elected power rests on an even narrower base. In off-year elections, senators and representatives typically gain office on the votes of fewer than 20% of their constituents. The current political distress has been diagnosed as, among other things, the failure of ill-informed citizens. Those things that once linked ordinary people to governing—namely, political parties and the media—for one reason or another no longer seem adequate to the task of educating voters about their political representatives. It is an ill-informed citizen who becomes an apathetic non-voter. When the people go missing from the process of self-government, government itself suffers from the loss. There is a pressing need, therefore, for an educational tool that will provide the ordinary citizen with meaningful and current information about his/her political representatives.

OBJECTS OF THE INVENTION

It is an object of the present invention to provide a card game that is both educational and entertaining.

It is another object of the present invention to provide a card game that educates players about current U.S. political figures.

It is a further object of the present invention to provide educational cards that can be used to play one or more games directed to politics while, at the same time, educating the players of such game or games about their political representatives.

It is a still further object of the present invention to provide an educational game system into which educational playing cards may be integrated via a looseleaf-type game binder divided into state sections representing the states of the United States.

These and other objects and advantages of the present invention will become apparent from review and consideration of the attached description of the invention, appended claims, and accompanying drawings.

SUMMARY OF THE INVENTION

The present invention is directed to a card game that satisfies the need for an educational tool that educates citizens/players about their current U.S. political representatives. The card game comprises a plurality of playing cards capable of being integrated into an educational game system via a looseleaf-type game binder having one or more pages. The game binder may be divided into state sections, each section representing a state of the United States.

Each playing card of the present invention has a front surface and a back surface. The front surface has a first picture section including a photograph of a political figure (senator, representative, or the like). The front surface also has a name identification section setting forth the name of the political figure depicted in the first picture section. The front surface further includes a job title section indicating the political office held by the political figure. The back surface preferably includes a general information section, a voting record information section, and a political ratings information section. Each of these sections corresponds in subject matter to the political figure depicted on the front surface of the playing card. The back surface of each playing card may also include a second picture section and/or a map indicating the geographic region represented by the political figure depicted on the front surface of the playing card.

Each playing card may further include information encoded on either the front surface or the back surface thereof indicating the political ideology of the political figure who is portrayed on the front surface. Such encoded information is not readily decipherable by the casual observer.

The looseleaf-type game binder of the present invention may provide a means for storing and organizing the playing cards. More importantly, the game binder may also provide a means for deciphering the information encoded on each playing card.

BRIEF DESCRIPTION OF THE DRAWINGS

FIGS. 1*a* and 1*b* are front surface illustrations of a playing card of the present invention.

FIG. 2 is a back surface illustration of a playing card of the present invention.

FIG. 3 is a back surface illustration of a further embodiment of a playing card of the present invention having a second picture of the relevant political figure.

DETAILED DESCRIPTION OF THE INVENTION

Figure 4:
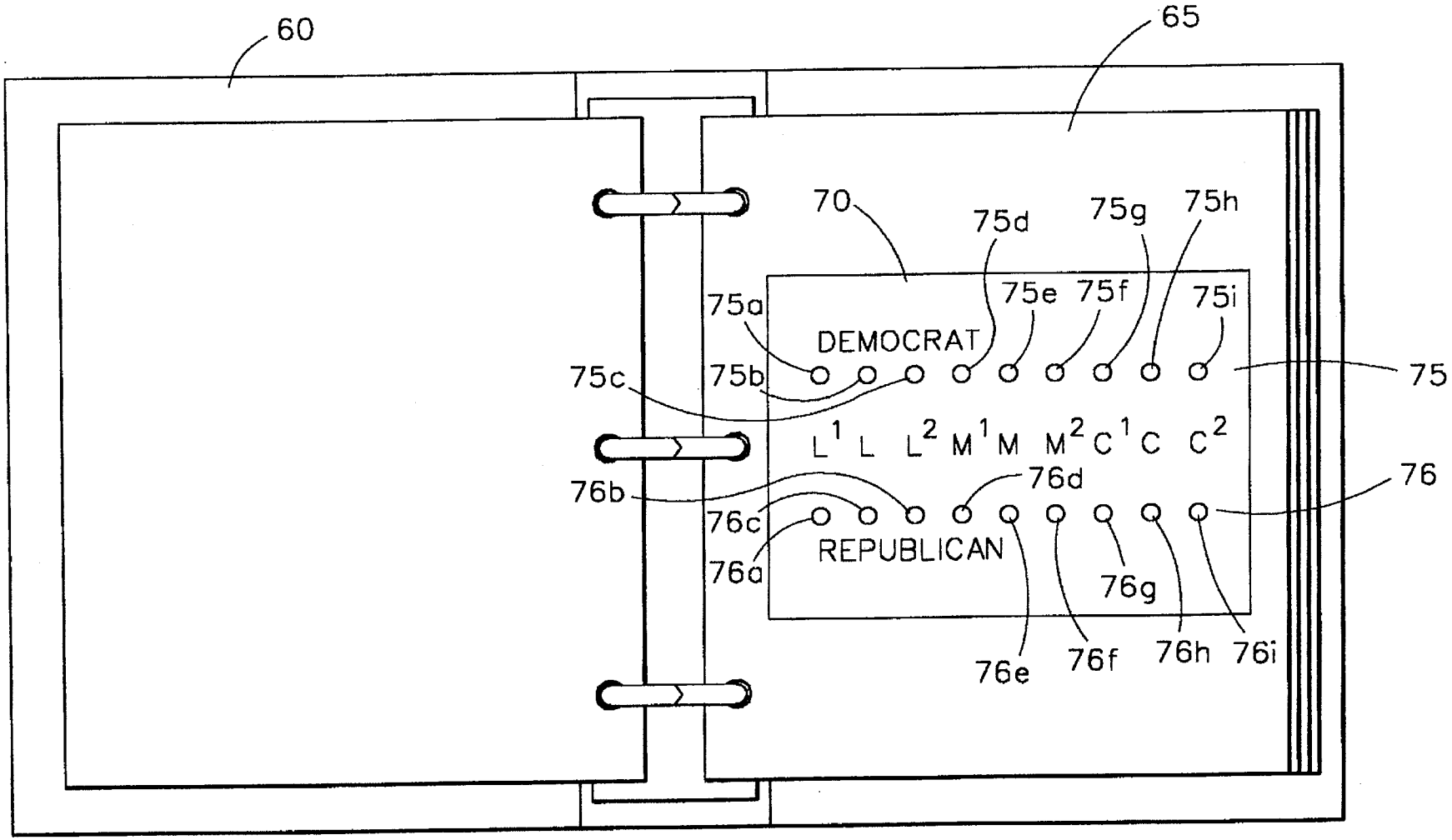
FIG. 4 is an isometric view of a looseleaf-type game binder of the present invention opened to reveal a special pocket arranged and constructed to accept individual playing cards thereby indicating the political ideology of the political figure depicted thereon.

Through the years, cards, and especially playing cards, have known many uses, including use as educational aids. When used as an educational aid, a card will typically include general identifying information and/or questions on one side and specific information to be remembered or recalled on the opposite side. Someone using such a card first looks at one side to determine the subject matter to be remembered or recalled, reviews in his/her mind what information he/she can recall and then, after turning over the card, checks the information provided to see whether his/her recollection was correct. Alternatively, the user, after first identifying the subject matter on one side of the card, will immediately reverse the card to view the information provided thereon, study it briefly to commit it, hopefully, to memory, and then turn over the card. The information committed to memory is immediately recalled, after which the material is checked against the information provided on the other side of the card. The card may also be returned immediately to the deck and brought up later for subsequent recall. Various games have been devised for the use of such basic informational cards to add the interest of a game or sporting-type procedure to the related tasks of memorization and learning.

In recent years, the voting public has increasingly become divorced from knowledge of its elected representatives or candidates for election. This estrangement can be attributed to many things. The pace of modern life reduces the time available for monitoring what one's elected officials are doing or stand for. Moreover, the sheer volume of information available frequently results in the public knowing more about what representatives of other constituencies are doing than what its own representatives are doing or stand for. This estrangement is believed to be a major cause of voter apathy.

The present inventors, recognizing this serious trend in U.S. political culture, have devised a political game and a set of political game cards to aid in arousing interest in the political process by introducing an element of recreation and gaming into acquiring political information. The political cards by which such information may be gained in a game situation in accordance with the present invention include, on one side of each card, at a minimum, an identification of an elected political representative or other political figure. Such identification usually includes a picture of the political figure, his/her name, and the political office that he/she holds. The identification could also include the geographic region represented by the office holder or candidate and/or the political party to which he/she belongs. These elements of identification information may be referred to as "primary information." Items of primary information are also listed on the back surface of the card, together with other information, designated as "secondary information," such as, preferably, general information, voting record information, and political ratings information.

Generally, in playing an educational political game in accordance with the teachings of the present invention, a series of cards with different political figures or candidates for political office identified on the front surfaces thereof are first dealt to the various players. Based upon the primary information on the front surface of each card, such as a picture of the political figure or candidate for political office, each player will try to identify an item of primary information provided on the back surface of each card, such as the geographic region represented by the political figure or candidate, or the political office held or sought by the political figure or candidate. If a player correctly identifies such primary information, he/she may keep the card, but if he/she fails, he/she must give up the card which will preferably be placed in a temporary discard pile or, alternatively, returned to the deck. The aim of the game is to build a "political consensus" whereby the first player to have in his/her hand a given number of cards of office holders or candidates sharing similar political characteristics will be declared the winner. This consensus will normally be based upon some item of secondary information such as political ideology (ie. left-leaning liberal, right-leaning conservative, and the like), but may also involve the use of primary information other than the picture or name of the candidate. For example, a political consensus might be built for elected political figures who come from large cities, or Democrats who come from the Midwest, or Republicans who come from the East Coast—all items of secondary information that might come from the general information section. Preferably, a consensus will be based upon the political ideologies of the political figures. In the case of a tie between two or more players, a situation of "gridlock" is declared and the gridlocked players must surrender their cards to the pile of cards that remain undistributed. Such pile is reshuffled. Each of the gridlocked players then receives one card from the reshuffled pile and game play resumes.

The consensus information may be included on the back surface of the card where it is not immediately visible. However, to add further interest to the game and/or enable the cards to be used for other educational purposes, such consensus information, preferably information regarding political ideology, may be provided in some coded form such as, for example, a normally not very noticeable mark or the like which, when the card is placed in a decoding device, becomes clearly evident. One convenient way to effect this is to have a mark on the back surface of the card in a certain location which, when the card is placed in a special pocket in a holder or the like, will come up beside a designation of political ideology set forth on the holder. Such a decoding pocket may be provided on or included in a storage container for the cards such as a special pocket in a looseleaf-type binder for the cards, or the like, or a pocket on top of a box or container for the cards. The hidden information may also be brought out or decoded by placing a card inside a pocket having a specially colored window which has a coordinately colored information section visible on the card surface, or encoded on the card in invisible print which is brought out by so-called black light or other special radiation, if held under such light, or magnetically or electronically encoded on the card and brought out by placing the card in a simple electronic decoder similar to decoders of so-called "smart-cards" or the like.

There may be related games using cards of increased difficulty in which highly sophisticated players may use cards having information arranged in a very difficult manner, while less sophisticated players may use information arranged in an easier, more readily informative manner. A game for sophisticated players from Washington, D.C., for example, might contain only a picture of an elected political figure on the front surface of the card for identification of the political figure. A sophisticated version of the game might also include pictures of typically more obscure political figures such as cabinet members, United Nations officials, and the like, to provide additional variety. In contrast, a preferred arrangement for the general public will include cards having, in addition to the picture, other primary information provided on the front surface of each card such as the political figure's name and political office.

The information cards of the present invention may also be used by a single player rather than by a group of players. For example, a single player game would require that a player select a card, look at the identification information on the front surface of the card, and, either by looking at the back surface of the card or, more preferably, because of the interest it adds, by slipping the card in a decoding apparatus or device, reveal the hidden information, in the case of a card having such encoded information, to see if he/she was correct in his/her initial identification/knowledge of the political figure displayed on the card. Such a procedure can be endlessly fascinating to those having any interest at all in the political process.

FIG. 1*a* shows the front surface view of a single playing card 10 in accordance with the teachings of the present invention. The playing card 10 has a front surface 15. The front surface includes a first picture section 20 bearing the photograph or likeness of a U.S. political figure. The front surface also includes a name identification section 25 printed thereon which indicates the name of the political figure depicted in the first picture section 20. The front surface further includes a job title section 30 printed thereon which indicates the political office held by the political figure depicted in the first picture section 20 and identified in the name identification section 25. The first picture section 20, the name identification section 25, and the job title section 30 are presented in a manner so that the user of the card may easily view the displayed information.

FIG. 1*b* also shows the front surface view of a single playing card 10. FIG. 1*b* differs from FIG. 1*a* in that the positions of the name identification section 25 and the job title section 30 are interchanged.

FIG. 2 shows the back surface view of a single playing card 10 prepared in accordance with the teachings of the present invention. The playing card 10 has a back surface 35 that includes a general information section 40, a voting record information section 43, and a political ratings information section 45. These sections correspond in subject matter to the political figure identified on the front surface 15. The general information section 40 includes the political figure's name, the name of the geographic region that he/she represents, the date that he/she was elected or appointed to office, his/her political party affiliation, birth date, religion, employment history, and educational history. The general information section 40 also includes committee membership information. The voting record information section 43 includes the political figure's voting record on key issues. The ratings information section 45 includes political ratings of the political figure by various political groups such as the Americans for Democratic Action (ADA), the American Conservative Union (ACU), the Committee on Political Education (COPE), and the U.S. Chamber of Commerce (COC). The back surface 35 of the playing card 10 may also include a map 53 further denoting the geographic region represented by the subject political figure.

As mentioned above, each of the playing cards of the present invention may include information encoded on either the front surface or the back surface thereof indicating the political ideology of the political figure depicted on the front surface. Such encoded information is not immediately decipherable by the casual observer. In a preferred embodiment of the present invention, the playing card be includes a special mark 50 (shown in FIG. 2 encoded on the back surface 35) in the form of a colored dot, star, or the like. In actual use, the special mark 50 plays a key role in revealing the political ideology of each political figure depicted on each of the playing cards.

FIG. 3 shows the back surface view of another embodiment of the back surface 35 of a single playing card 10 prepared in accordance with the teachings of the present invention. The playing card be has a back surface 35 that includes a second picture section 55 in addition to a general information section 40, a voting record information section 43, a political ratings information section 45, a special mark 50, and a map 53.

FIG. 4 shows a looseleaf-type game binder 60 prepared in accordance with the teachings of the present invention. The game binder 60 contains one or more pages and provides a means for deciphering the information encoded on each of the playing cards to reveal the political ideology of the political figure depicted thereon. In the preferred embodiment of the present invention, a page 65 of the looseleaf-type game binder 60 has a special pocket 70. The special pocket 70 has two opposing rows 75 and 76 of cutouts 75*a–i* and 76*a–i*. The two rows 75 and 76 are labeled "Democrat" and "Republican," respectively. A cutout in one row and the cutout opposite it in the other row form a pair of cutouts. For example, cutout 75*a* and cutout 76*a* form a pair of cutouts. The pairs of cutouts are labeled, from left to right, $L^1$, L, $L^2$, $M^1$, M, $M^2$, $C^1$, C, and $C^2$, respectively, where $L^1$ stands for "Ultra Liberal", L stands for "Liberal", $L^2$ stands for "Moderate-Leaning Liberal", $M^1$ stands for "Left-Leaning Moderate", M stands for "Moderate", $M^2$ stands for "Right-Leaning Moderate", $C^1$ stands for "Moderate-Leaning Conservative", C stands for "Conservative", and $C^2$ stands for "Ultra Conservative." In actual use, the special pocket 70 accepts a playing card to allow the special mark 50 thereon to show through only one cutout in only one row 75 or 76. The one cutout showing the special mark 50 serves to indicate the political ideology (Liberal, Moderate, Conservative, or the like) of the political figure appearing on the playing card. The two rows 75 and 76 serve to correlate the political figure's political ideology with his/her party affiliation.

The looseleaf-type game binder may also include sections or informational inserts containing explanations of the voting record information and ratings that appear on the back surface of each playing card. As an educational supplement, the binder may further include information about each of the states of the United States represented in state sections therein such as state trivia, maps highlighting voting districts, listings of state government officials, and the like.

Figure 5:
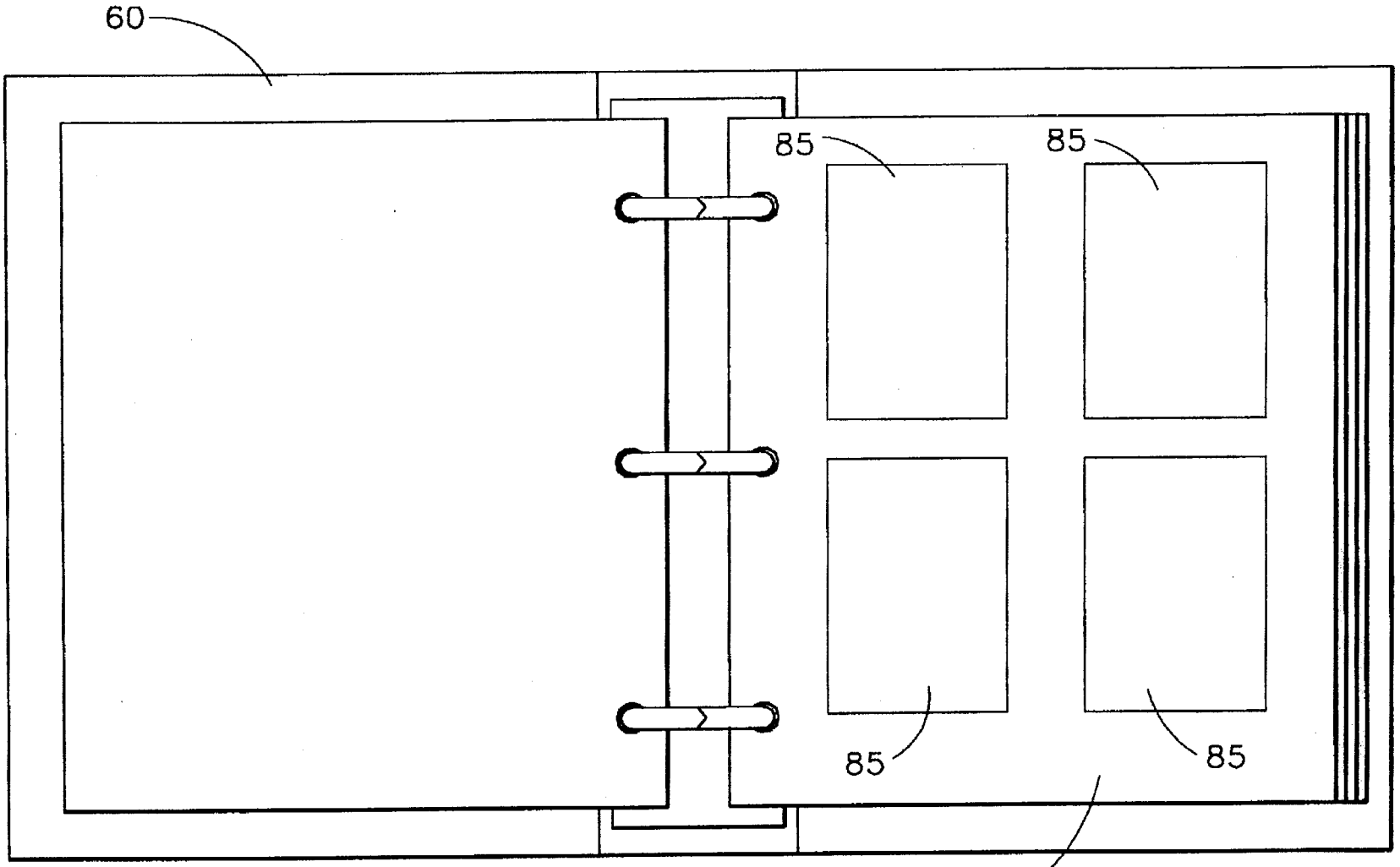
FIG. 5 is an isometric view of the looseleaf-type game binder of FIG. 4 opened to reveal a playing card storage/organization section.

FIG. 5 shows the looseleaf-type game binder 60 of the present invention opened to another page 80. The page 80 serves as a playing card storage/organization section including pockets 85 for storing and organizing playing cards. Each state section of the game binder 60 contains its own playing card storage/organization section for storing and organizing the cards of the political figures who represent that state.

As alluded to earlier, the object of a preferred embodiment of the game of the present invention is to build a political consensus by obtaining a predetermined number of playing cards representing political figures who share the same political ideology. During normal play of the preferred game of the present invention, the plurality of playing cards is initially shuffled. Each player is then dealt one card with the front surface 15 facing up. Taking turns, each player must name the state represented by the political figure on his/her card. If the player correctly names the state, he/she keeps the card. If the player incorrectly names the state, he/she must relinquish the card by placing it at the bottom of the deck. This procedure is repeated until at least one player is in possession of five cards. A player with five cards places each card, one-at-a-time, into the special pocket 70 of the looseleaf-type game binder 60. The special mark 50 on each playing card then becomes visible through only one of the plurality of cutouts 75*a–i* and 76*a–i* in only one of the two opposing rows 75 or 76. The cutout and row revealing the special mark 50 indicate the political ideology of the political figure on that playing card. If a player holds the five playing cards of political figures who share the same political ideology (ie. five Conservatives, five Moderates, five Ultra Liberals, or the like), that player has built a political consensus and wins the hand. Play continues until at least one player has built a consensus. In the event of a tie between two or more players, a "gridlock" situation exists. When two or more players are gridlocked, such players must surrender their cards to the pile of cards that remain to be dealt. Such pile is reshuffled. Each of the gridlocked players then receives one card from the reshuffled pile and game play resumes. Playing cards depicting freshman politicians may be used as wild cards.

As mentioned earlier, game play may be varied by changing the basis for the consensus. For example, a consensus based on political ideologies may be replaced by one based on a particular vote on any one or more of the issues identified in the voting record information section 43 on the back surface 35 of each playing card. In such case, the object of the game would be to collect a predetermined number of playing cards representing political figures having the same voting record on a given issue or issues.

Other variations of game play may require that the consensus or winning hand consist of a predetermined number of playing cards depicting political figures who represent the same preselected state, or who share the same political party affiliation.

Figure 6:
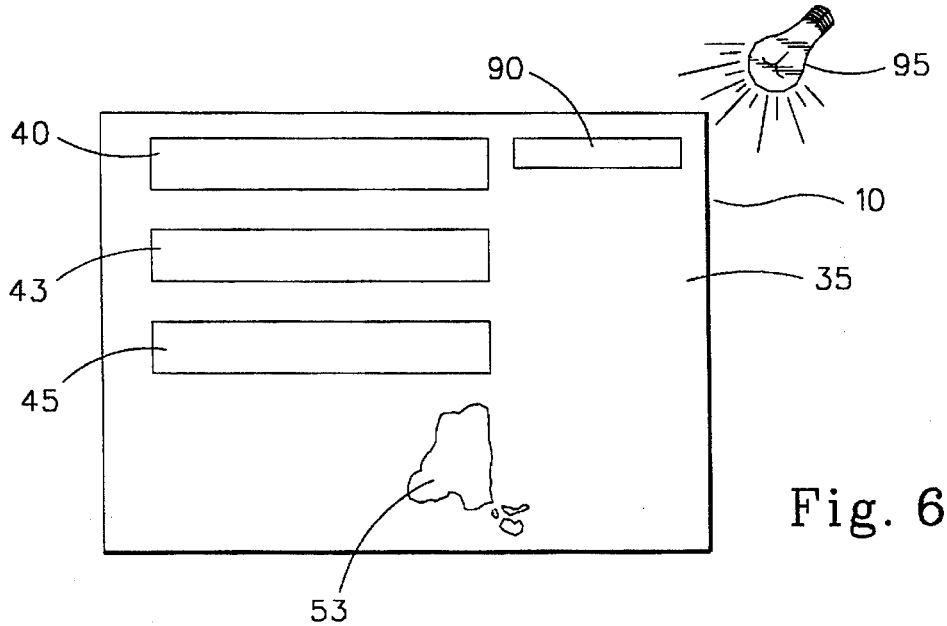
FIG. 6 is a back surface illustration of a playing card of the present invention shown placed under a special light to reveal otherwise invisible information.
Figure 7:
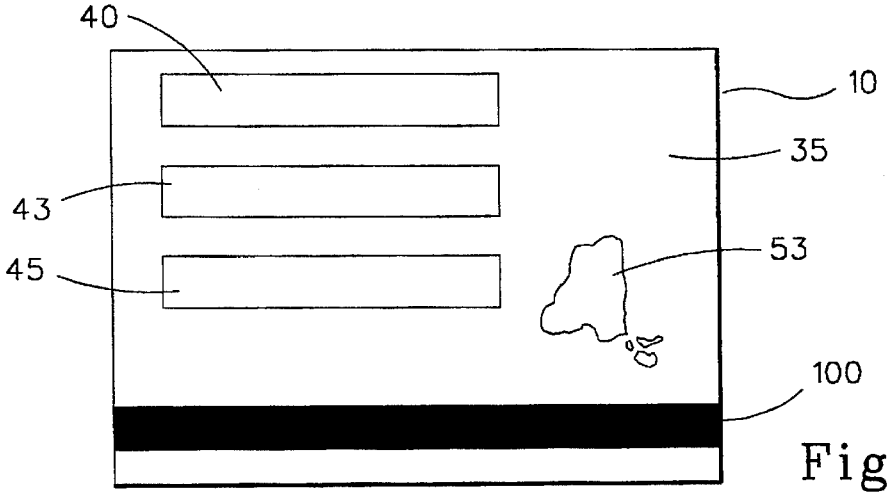
FIGS. 7*a* and 7*b* are back surface illustrations of a playing card of the present invention on which information is encoded magnetically (via a magnetic strip) or electronically (via a bar code).
Figure 8:
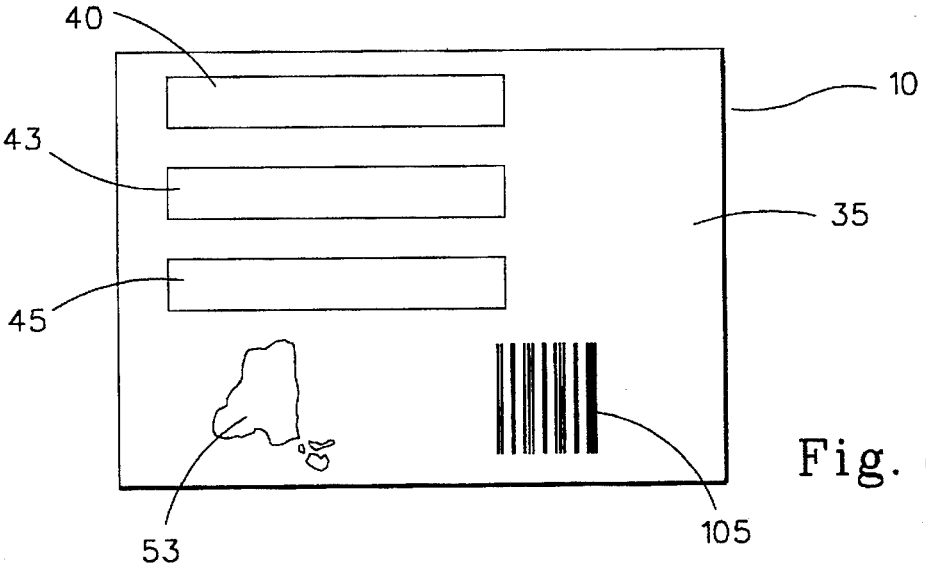

More interest may be added to the educational game of the present invention if, as described above, information is encoded on the card to be brought out by additional apparatus—for example, the special marks disclosed earlier. Such encoded information may be brought out in a variety of other ways such as with a differentially colored window in a pocket of a looseleaf-type binder, as shown in FIG. 5, by the use of a special light 95 under which the card is held to bring out otherwise invisible information 90, as shown in FIG. 6, or by the use of an electronic readout apparatus where the card is encoded magnetically (eg. via a magnetic strip 100) or electronically (eg. via a bar code 105) in the manner of a so-called "smart-card" or the like, as shown in FIGS. 7*a* and 7*b*.

The game of the present invention, as well as the possible variations thereof, offer players an entertaining and educational experience. The game provides players with meaningful and current information about their political representatives. Continued play of the game and exposure to the cards thereof will make politically well-informed citizens of its players. As a result, those players who, because of their political ignorance, were once politically apathetic non-voters, will, more likely than not, become politically concerned voters.

The foregoing disclosure and description of the invention is illustrative and explanatory thereof. Modifications to the present invention may be made within the scope of the appended claims, which scope is to be accorded the broadest possible interpretation, without departing from the true spirit of the invention. The present invention should be limited by only the following claims and their legal equivalents.

What is claimed is:

1. An educational card game comprising:

(a) a plurality of playing cards, each of the cards having a front surface and a back surface, the front surface having a first picture section bearing the photograph or likeness of a political figure, the front surface also having a name identification section indicating the name of the political figure depicted thereon and a job title section indicating the political office held by the political figure, the back surface having a general information section, a voting record information section, and a political ratings information section, each section corresponding in subject matter to the political figure depicted on the front surface, (b) the general information section on the back surface of each of the playing cards including the name of the political figure appearing on the front surface, the name of the geographic region that he/she represents, the date that he/she was elected or appointed to office, the political figure's political party affiliation, birth date, religion, employment history, educational history, and committee membership information, (c) the back surface of each of the playing cards further including a second picture section bearing a photograph or likeness of the political figure depicted on the front surface, (d) the back surface of each of the playing cards including a map illustrating the geographic region represented by the political figure depicted on the front surface, (e) each of the playing cards having information indicating the political ideology of the political figure encoded on one of the front surface or the back surface thereof so that the information is not readily decipherable by the casual observer, (f) means for deciphering the information encoded on each of the playing cards to reveal the political ideology of the political figure depicted thereon, (g) each of the playing cards including a special mark positioned thereon for encoding information indicating the political ideology of the political figure depicted on the front surface thereof, (h) the deciphering means comprising a looseleaf-type binder having one or more pages, at least one page having a special pocket, the special pocket having a plurality of cutouts arranged in at least two rows, each row having indicia representing different party affiliation, each cutout in each row having indicia representing a different political ideology in each party affiliation, said special pocket being sized to receive a playing card therein, said special mark on said card being specifically located on the card such that when the card is placed in said special pocket said special mark shows through only one of the cutouts indicating the party affiliation and political ideology of the political figure on said card.

2. An educational card game in accordance with claim 1, wherein the looseleaf-type binder includes a plurality of state sections, each of the state sections representing a state of the United States.

3. An educational card game in accordance with claim 2, wherein each of the state sections of the looseleaf-type binder includes means for storing and organizing the playing cards.

4. A method for playing an educational card game comprising the steps of:

(a) dealing a playing card having a front surface and a back surface, front surface up, to each of a number of players from a deck of shuffled playing cards, such card having the likeness of a single political figure associated with a specific political region identified on the opposite side of the card from appearance of the likeness of the political figure, (b) requiring each player, in turn, to correctly name the geographic region represented by the political figure whose likeness is displayed on the front surface of his/her playing card;

(c) requiring each player who has failed to correctly name the geographic region represented by the political figure on his/her playing card to relinquish such card by placing it at the bottom of a deck of undistributed cards;

(d) allowing each player who has correctly named the geographic region represented by the political figure on his/her playing card to retain such card;

(e) repeating the above steps until at least one player is in possession of a predetermined number of playing cards, each card having encoded information on its surface representative of the political ideology of the political figure whose likeness is on the card, (f) subjecting the cards to a decoding means to decipher the political ideology of the political figures on each of the predetermined number of playing cards, to reveal the political ideology of each political figure represented on each of the cards;

(g) ascertaining if the political figures represented on all of the predetermined number of playing cards share the same political ideology;

(h) declaring as the winner the player who is the first to be in possession of the predetermined number of playing cards representing political figures all of whom share the same political ideology;

(i) in the event of a tie between two or more players, requiring such players to surrender their cards to the deck of undistributed cards, reshuffling such deck, dealing to each of the players who were tied one card from the reshuffled deck, and resuming game play; and (j) if no player has been declared a winner, resuming and continuing game play in accordance with the above steps until a player has been declared a winner.

5. A method for playing an educational card game in accordance with claim 11 wherein each player decodes the political ideology of the political figures on his/her cards by physically placing the card in a deciphering device.

6. A method for playing an educational card game in accordance with claim 5 wherein the player places the cards in a deciphering device including a visually open window space that allows visual inspection of pertinent information for the political figure.

7. A method for playing an educational card game comprising the steps of:

(a) dealing a playing card having a front surface and a back surface, front surface up, to each of a number of players from a random supply of playing cards, each of which cards has an identification of a specific political figure associated the a specified geographical region, (b) requiring each player, in turn, to correctly name the geographic region represented by the political figure whose identification is displayed on the front surface of his/her playing card;

(c) requiring each player who has failed to correctly name the geographic region represented by the political figure on his/her playing card to relinquish such card by placing it at the bottom of a deck of undistributed cards;

(d) allowing each player who has correctly named the geographic region represented by the political figure on his/her playing card to retain such card;

(e) repeating the above steps until at least one player is in possession of a predetermined number of playing cards;

(f) referring to information on each of the predetermined number of playing cards, to determine the political ideology of each political figure identified on each of the cards;

(g) ascertaining if the political figures identified on all of the predetermined number of playing cards share the same political ideology;

(h) declaring as the winner the player who is the first to be in possession of the predetermined number of playing cards identifying political figures all of whom share the same political ideology;

(i) in the event of a tie between two or more players, requiring such players to surrender their cards to the deck of undistributed cards, reshuffling such deck, dealing to each of the players who were tied one card from the reshuffled deck, and resuming game play; and (j) if no player has been declared a winner, resuming and continuing game play in accordance with the above steps until a player has been declared a winner.

8. A method of playing an educational card game in accordance with claim 7 wherein the political figure identified on each card is identified by his/her picture which the player associates with the geographic region.

9. A method of playing an educational card game in accordance with claim 7 wherein the political figure is identified on each card is identified by his/her name which the player associates with the geographic region.

10. A method of playing an educational card game in accordance with claim 7 wherein the political figure is identified with his name and picture which the player associates with the geographical region.

11. A method of playing an educational card game in accordance with claim 10 wherein the political ideology of the political figures appears on the cards in encoded form and the players decipher such encoding to learn the political ideology.

12. A method of playing an educational card game in accordance with claim 11 wherein the players use a decoding means to decipher the political ideology of each political figure.

13. A method of playing an educational card game in accordance with claim 12 wherein the players place the cards in a decoding device to determine the political ideology of the political figure.

14. A method for playing an educational card game in accordance with claim 13 wherein the player places the cards in a deciphering device including a pocket having a visually open window space that allows visual inspection of pertinent information for the political figure included with other similar information on the card surface.

15. A method for playing an educational game in accordance with claim 10 wherein the card surfaces contain additional biographical information concerning the political figures identified which information is at least involuntarily learned during playing of the game.

* * * * *